US005826956A

United States Patent [19]

Norton

[11] Patent Number: 5,826,956

[45] Date of Patent: Oct. 27, 1998

[54] FOLLOWER FOR FILE DRAWER

[75] Inventor: Allen Norton, Salamanca, N.Y.

[73] Assignee: Signore, Incorporated, Ellicottville, N.Y.

[21] Appl. No.: 938,870

[22] Filed: Sep. 26, 1997

[51] Int. Cl.[6] ..... B65D 25/04

[52] U.S. Cl. ..... 312/183; 312/348.3; 220/544

[58] Field of Search ..... 312/183, 193, 312/348.3, 348.5; 220/543, 544, 545, 546

[56] References Cited

U.S. PATENT DOCUMENTS

| | | | |
|---|---|---|---|
| 1,227,172 | 5/1917 | Moore . | |
| 2,281,067 | 4/1942 | Bergman | 220/545 |
| 2,501,491 | 3/1950 | Beno . | |
| 3,109,432 | 11/1963 | Regenhardt . | |
| 3,227,504 | 1/1966 | Dunham . | |
| 3,450,304 | 6/1969 | Schreyer | 220/546 X |
| 3,499,695 | 3/1970 | Studinski | 312/330.1 X |
| 3,612,337 | 10/1971 | Harger . | |
| 4,303,286 | 12/1981 | McClellan | 220/546 X |
| 4,305,217 | 12/1981 | Green et al. | 220/544 X |
| 4,735,324 | 4/1988 | Wilcek | 220/544 X |
| 4,881,653 | 11/1989 | Norton . | |
| 5,111,959 | 5/1992 | Glickman . | |
| 5,312,180 | 5/1994 | Tieder et al. . | |
| 5,366,283 | 11/1994 | Crose | 312/183 |
| 5,433,336 | 7/1995 | Kristoffersson . | |

FOREIGN PATENT DOCUMENTS

| | | | |
|---|---|---|---|
| 1220630 | 5/1960 | France | 220/544 |

*Primary Examiner*—Peter R. Brown
*Assistant Examiner*—Hanh V. Tran
*Attorney, Agent, or Firm*—Bean, Kauffman & Snyder

[57] ABSTRACT

In the combination of a file drawer having a pair of spaced-apart vertical side walls formed with recessed guide channels extending lengthwise of each side wall between front and rear ends of the file drawer; and a follower having a body portion sized to be received within the file drawer with a pair of spaced side edges thereof arranged adjacent the side walls and a pair of guide members upstanding from said body portion adjacent the side edges and sized and arranged for receipt within the guide channels and for movement lengthwise thereof; the improvement comprising a mounting opening extending through one of the side walls in alignment with the guide channel thereof, the opening being sized to permit at least a portion of one of the guide members to project outwardly therethrough to a degree sufficient to accommodate installation of the follower within the file drawer by inserting the follower into the file drawer to assume a starting position with the body portion arranged at an angle of other than 90° relative to the side walls and the one guide member arranged to project outwardly through the opening and then twisting the follower to assume an installed position with the body portion arranged at an angle of approximately 90° relative to the side walls and the guide members positioned within the guide channels.

8 Claims, 2 Drawing Sheets

FOLLOWER FOR FILE DRAWER

BACKGROUND OF THE INVENTION

The present invention relates to the construction of file drawers of the type commonly used for retaining file folders upstanding in an orderly fashion within the drawer. In a typical construction, an adjustable follower is formed with a body portion, which extends transversely across the interior of the file drawer between its sidewalls, and a pair of guide members, which are arranged to project normal to the body portion and are slidably received within a pair of guide channels arranged to extend lengthwise of the side walls between front and rear ends of the file drawer.

In prior constructions of the type having guide members formed integrally with the body portion, it is known to assemble the follower within a file drawer by inserting the follower between the side walls, before the front wall or rear wall is joined to the side walls and by spreading apart resilient metal side walls of a fully assembled file drawer sufficiently to receive the follower therebetween. It is also known that a follower formed of flexible plastic material may be physically deformed incident to insertion thereof within the file drawer, whereafter the follower is permitted to return to its as-formed condition.

SUMMARY OF THE INVENTION

The present invention relates to an improved file drawer and follower construction allowing a fully assembled follower to be installed within a fully assembled file drawer without requiring deformation of either the file drawer or the follower.

In accordance with the present invention, one side wall of a file drawer is formed with a mounting opening, which is aligned with its guide channel and sized and arranged to allow at least a portion of one of the guide members of the follower to project outwardly therethrough to a degree sufficient to accommodate installation of the follower. Specifically, the follower is inserted into the file drawer to assume a starting position, wherein the body portion of the follower is arranged at an angle other than 90° relative to the side walls and the one guide member is arranged to project outwardly through the mounting opening. The follower is then twisted to assume an installed position, wherein the body portion is arranged at an angle of approximately 90° relative to the side walls and the guide members are positioned within the guide channels for sliding movement lengthwise thereof.

The guide members engage with guide surfaces of the guide channels to define forward and rearward tilted positions of the follower within the file drawer, wherein items stored within the file drawer intermediate the follower and the front of the drawer, and in engagement with the follower, tend to move the follower into its forward tilted position, wherein the follower is temporarily locked against movement lengthwise within the file drawer. Preferably, in all tilted positions of the follower, excepting one position at or adjacent to the rearward tilted position of the follower, the shape and orientation of mounting opening is such as to prevent twisting of the follower from its installed position into its starting position, thereby to avoid unintended disassembly of the follower relative to the file drawer.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
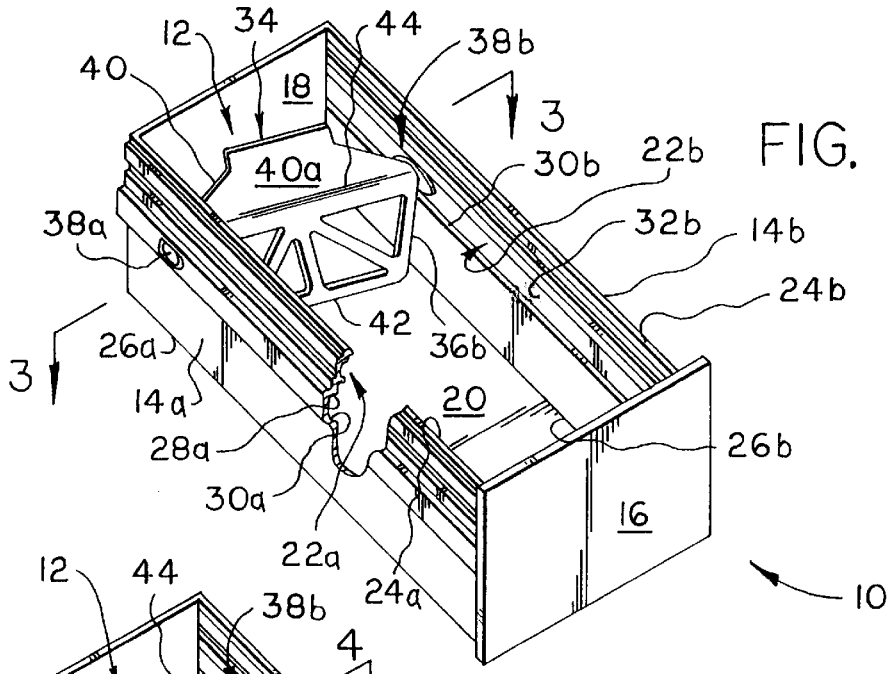
FIG. 1 is a prospective view showing a follower placed in a file drawer to assume a starting position.
Figure 2:
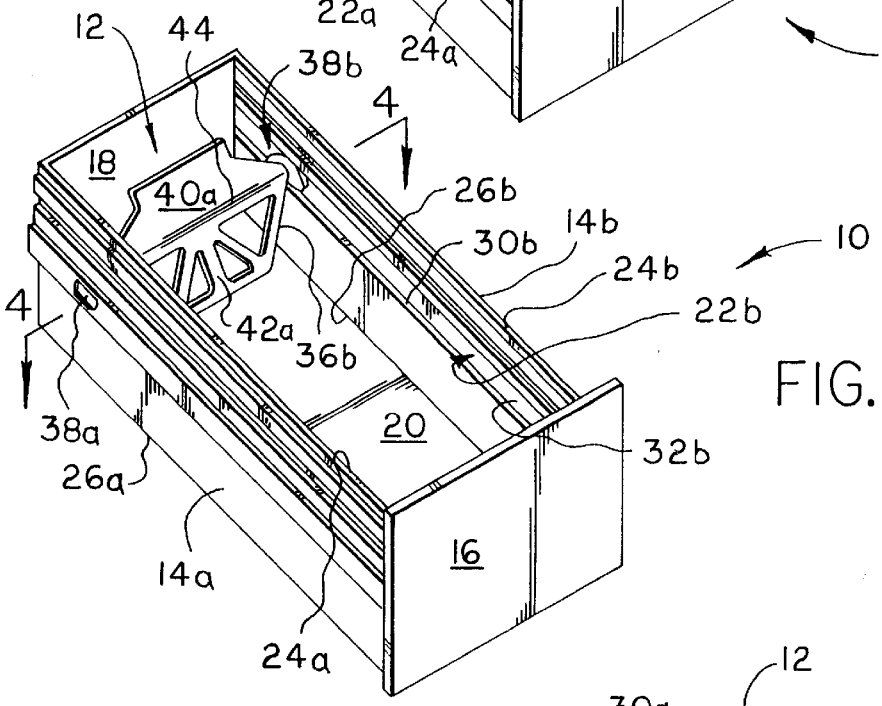
FIG. 2 is a view similar to FIG. 1, but showing the follower after it is twisted to assume an installed position.
Figure 3:
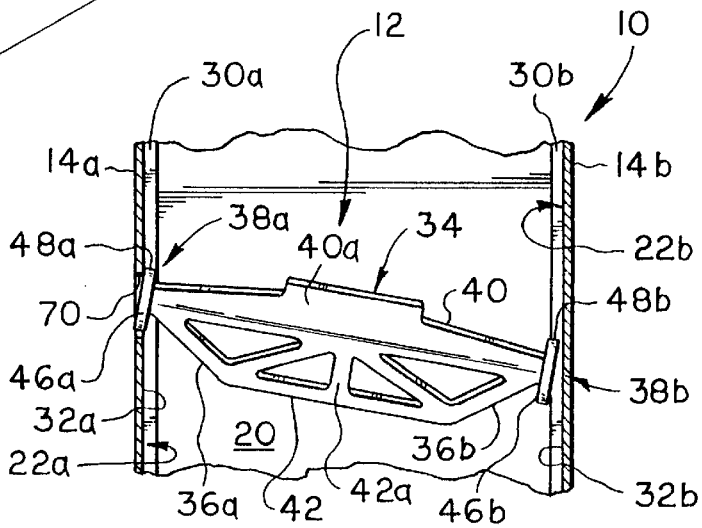
FIG. 3 a sectional view taken generally along the line 3—3 in FIG. 1.
Figure 4:
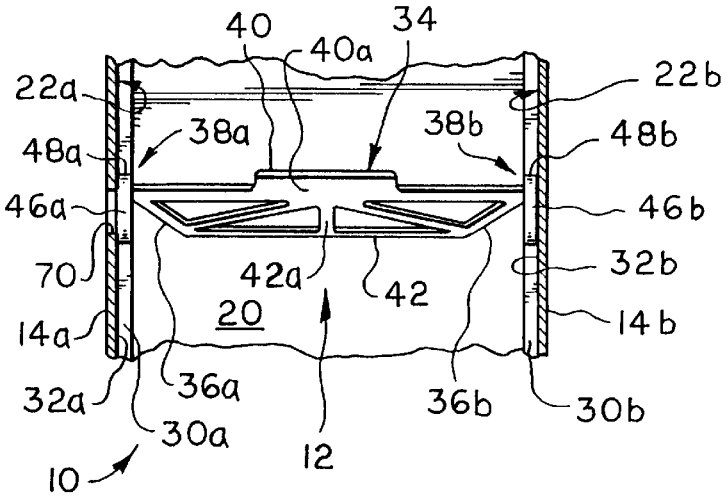
FIG. 4 is a sectional view taken generally along the line 4—4 in FIG. 2.

The present invention is shown in the drawings as comprising a file drawer 10 in combination with a follower 12, wherein the file drawer is conventional from the standpoint that it includes a pair of spaced apart side walls 14*a* and 14*b* having their opposite ends joined to front and rear end walls 16 and 18, and arranged together with the front and rear walls to upstand from a rectangular bottom wall 20. In a typical construction, side walls 14*a* and 14*b* are formed with facing guide channels 22*a* and 22*b*, which extend lengthwise of the side walls intermediate their upper and lower edges 24*a*, 26*a* and 24*b*, 26*b*, respectively. The guide channels 22*a* and 22*b* are in turn defined by facing upper and lower guide surfaces 28*a*, 30*a* and 28*b*, 30*b*, respectively, which are joined by connecting surfaces 32*a* and 32*b*.

Follower 12 generally includes a body portion 34 having a pair of spaced side edges 36*a* and 36*b*; and a pair of guide members 38*a* and 38*b* upstanding from the body portion adjacent side edges 36*a* and 36*b*, respectively. Preferably, body portion is defined by upper and lower panel portions 40 and 42 having generally planer forwardly facing or front surfaces 40*a* and 42*a* with surface 40*a* being inclined rearwardly relative to surface 42*a* generally along a line or bend area 44 extending transversely between side edges 36*a* and 36*b* in alignment with guide members 38*a* and 38*b*.

In that guide members 38*a* and 38*b* are of like construction, only guide member 38*a* will be specifically described with like parts of guide member 38*b* being designated by like numerals bearing a "b" suffix.

Figure 5:
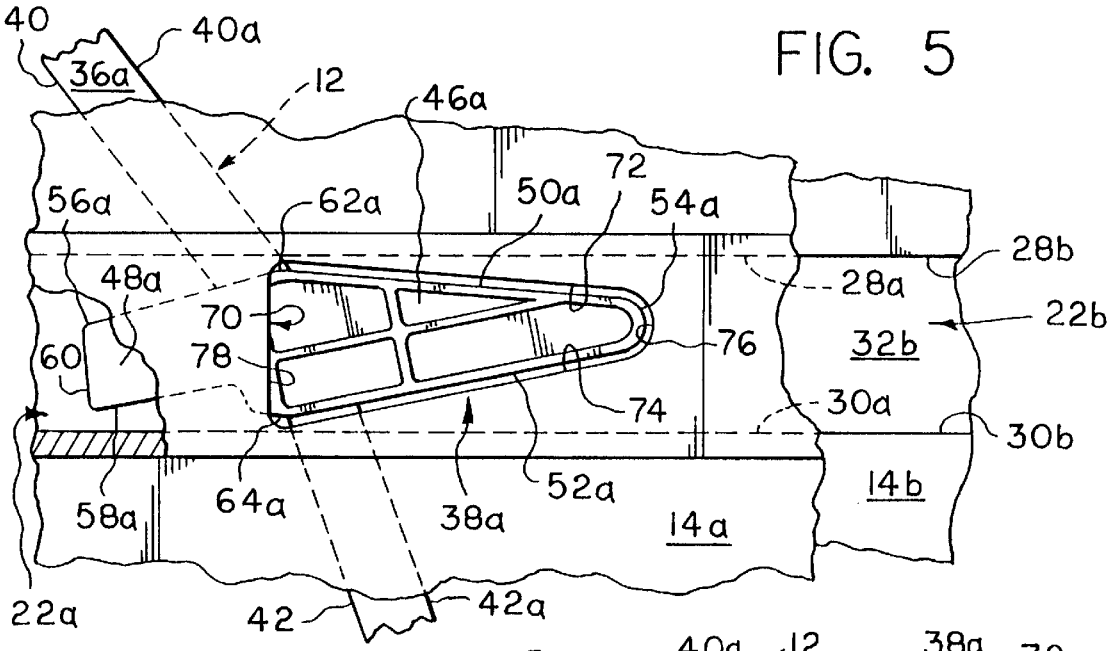
FIG. 5 is a side elevational view of one side of the file drawer showing its follower mounting opening and the follower arranged to assume a rearward tilted position.
Figure 6:
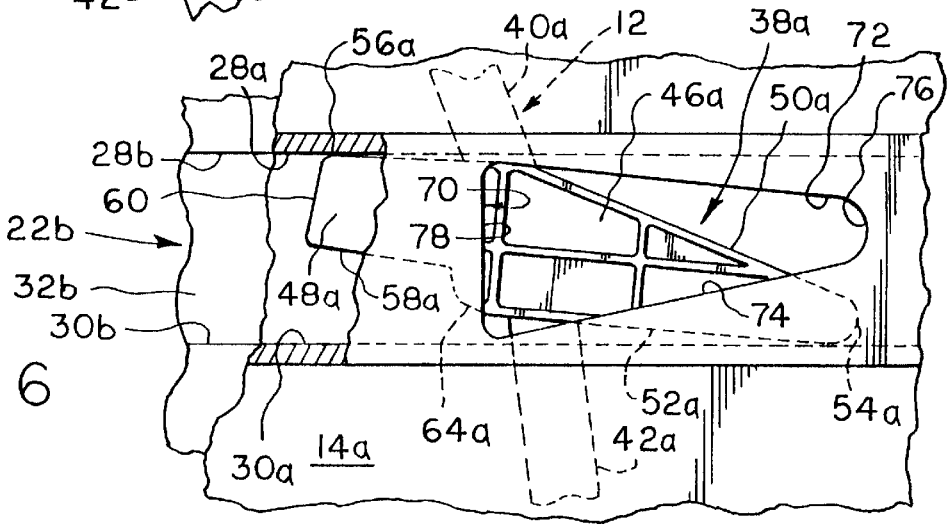
FIG. 6 is a view similar to FIG. 5, but showing the follower arranged in its forward tilted position.

Guide member 38*a* is best shown in FIGS. 5 and 6 as including a forwardly projecting or leading guide portion 46*a* and a rearwardly projecting or trailing guide portion 48*a*. Leading guide portion 46*a* is bounded by upper and lower edge portions 50*a* and 52*a*, which are arranged to converge in a direction extending towards drawer front end or end wall 16 and preferably joined by a rounded front end edge portion 54*a*.

Trailing guide portion 48*a* is bounded by upper and lower edge portions 56*a* and 58*a*, which are arranged to converge in a direction extending towards drawer rear end or end wall 18 and preferably joined by a squared off rear end edge portion 60*a*. Upper edge portions 50*a* and 56*a* are joined by an upper intermediate, rounded edge portion 62*a*, and lower edge portions 52*a* and 58*a* are joined by a lower, intermediate rounded edge portion 64*a*.

It will be understood that after mounting of follower 12 within drawer 10 in the manner to be described, body portion 34 extends transversely within the drawer between side walls 14*a* and 14*b* with panel surfaces 44*a* and 46*a* arranged to face relatively towards drawer front end wall 16 and guide members 38*a* and 38*b* slidably received within guide channels 22*a* and 22*b*, respectively. When so positioned, items such as files, not shown, stored within file drawer 10 intermediate follower 12 and front end wall 16 and in engagement with the follower, and particularly with front surface 42*a* of lower panel 42, tend to tilt the follower forwardly towards a maximum forward tilted position shown in FIG. 6, which is defined by engagement of lower edge portions of leading guide portions 46*a* and 46*b* with guide channel guide surfaces 30*a* and 30*b*, respectively, and by engagement of upper edge portions of trailing guide portions 48*a* and 48*b* with guide channel guide surfaces 28*a* and 28*b*, respectively.

Follower 12 may also be tilted rearwardly towards a maximum rearward tilted position, not shown, which may be defined by engagement of the upper edge portions of leading guide portions 46*a* and 46*b* with guide channel surfaces 28*a* and 28*b*, respectively, and by engagement of the lower edge portions of trailing guide portions 48*a* and 48*b* with guide channel guide surfaces 30*a* and 30*b*, respectively.

Reference is now made to FIGS. 3–6, wherein file drawer side wall 14*a* is shown as being formed with a through opening 70, which is arranged in alignment with connecting surface 32*a* of guide channel 22*a* and sized to permit at least a portion of guide member 38*a* to project ourwardly therethrough to a degree sufficient to accommodate for installation of follower 12 within file drawer 10 in the manner to be described. Opening 70 preferably corresponds in shape to leading guide portion 46*a* and is formed with upper and lower edge portions 72 and 74, which are arranged to converge in a direction extending towards drawer front end 16. The front and rear ends of edge portions 72 and 74 are joined by a rounded front edge portion 76 and a straight rear edge portion 78. It is preferable to arrange opening 70 such that upper edge portion 72 is arranged between the position shown in FIGS. 5 and 6, wherein it forms a relatively small acute angle relative to guide surface 28*a* on the order of about 15 degrees and a position in which it is disposed essentially parallel to such upper guide surface.

Follower 12 is installed within drawer 10 by manually inserting the follower downwardly into the drawer between side walls 14*a* and 14*b*, while the follower is arranged intermediate its maximum forward and rearward tilted positions with body portion 34 disposed at an angle on the order of about 45° degrees relative to the side walls; with panel front surfaces 40*a* and 42*a* arranged to face generally towards drawer front wall 16, and with guide members 38*a* and 38*b* disposed in vertical alignment with and relatively adjacent guide channels 22*a* and 22*b*. Follower 12 is then tilted and moved lengthwise within the drawer as required to position leading guide portion 46*a* of guide member 38*a* in alignment with through opening 70 to permit the follower to be twisted about a line extending vertically through drawer bottom wall 20 to cause the leading guide portion to move outwardly of the drawer through the opening to assume a starting position. In this starting position, leading guide portion 46*a* projects outwardly through opening 70 and trailing guide portion 48*b* projects into guide channel 22*b* with sufficient clearance to permit subsequent manual twisting of follower 12 relative to drawer 10 to assume an installed position, wherein body portion 34 is disposed normal or extends transversely of side walls 14*a* and 14*b* and guide members 38*a* and 38*b* are positioned essentially parallel to connecting surfaces 32*a* and 32*b* and for sliding movement lengthwise within guide channels 22*a* and 22*b*.

After follower 12 is arranged in its installed position, it can be moved lengthwise of drawer 10 and tilted relative thereto between its maximum rearward and forward tilted positions. The positioning of opening 70 with its upper edge portion 72 arranged as shown in FIGS. 5 and 6 serves to prevent movement of follower 12 between its installed and starting position for all positions of the follower except when same is intentionally pivoted rearwardly into its rearward tilted position shown in FIG. 5. For all other positions of follower 12, guide member 38*a* may be moved within guide channel 22*a* past opening 70 without such opening interfering with sliding movement of such guide member or permitting unintended disassembly of the follower relative to drawer 10.

What is claimed is:

1. In the combination of a file drawer provided with a pair of spaced-apart vertical side walls having guide channels extending lengthwise thereof intermediate front and rear ends of said file drawer; and a follower having a body portion sized to be received within said file drawer with a pair of spaced side edges thereof arranged adjacent said side walls and a pair of guide members upstanding from said body portion adjacent said side edges and sized and arranged for receipt within said guide channels and for movement lengthwise thereof, the improvement comprising in combination:

a mounting opening extending through one of said side walls in alignment with said guide channel thereof, said opening being sized to permit at least a portion of one of guide members to project outwardly therethrough to a degree sufficient to accommodate installation of said follower within said file drawer by inserting said follower into said file drawer to assume a starting position with said body portion arranged at an angle of other than 90° relative to said side walls and said portion of said one guide member arranged to project outwardly through said opening and then twisting said follower to assume an installed position with said body portion arranged at an angle of approximately 90° relative to said side walls and said guide members positioned within said guide channels, each of said guide members includes leading and trailing guide portions projecting in opposite directions normal to said body portion relatively towards said front and rear ends, respectively, said portion of one of said guide members is said leading guide portion of said one guide member and projects outwardly through said opening and said trailing guide portion of the other of said guide members projects into the guide channel of the other of the side walls when in said starting position, said opening corresponds in shape to said leading guide portion of said one guide member, said guide channels have upper and lower lengthwise extending guide surfaces, said leading and trailing guide portions each define downwardly and upwardly facing edge portions arranged to removably engage with said lower and upper guide surfaces of said guide channels, said downwardly and upwardly facing edge portions of said leading and trailing guide portions engaging with said lower and upper guide surfaces, respectively, to limit the extend of forwardly tilting movement of said follower within said file drawer to define a maximum forward tilted position, said upwardly and downwardly facing edge portions of said leading and trailing guide portions engaging with said upper and lower guide surfaces, respectively, to limit the extend of rearwardly tilting movement of said follower within said file drawer to define a maximum rearward tilted position, wherein items stored within said file drawer intermediate said follower and said front end of said file drawer in engagement with said body portion tend to tilt said follower to assume said maximum forward tilted position, and said leading guide portion of said one guide member is tilted from alignment with said opening when said follower is in said forward tilted position, so as to prevent twisting of said follower from said installed position into said starting position.

2. The combination according to claim 1, wherein said leading edge portion of said one guide member is aligned with said opening when said follower is relatively adjacent said maximum rearward tilted position.

3. In the combination of a file drawer provided with a pair of spaced-apart vertical side walls having guide channels extending lengthwise thereof intermediate front and rear ends of said file drawer; and a follower having a body portion sized to be received within said file drawer with a pair of spaced side edges thereof arranged adjacent said side walls and a pair of guide members upstanding from said body portion adjacent said side edges and sized and arranged for receipt within said guide channels and for movement lengthwise thereof, the improvement comprising in combination:

a mounting opening extending through one of said side walls in alignment with said guide channel thereof, said opening being sized to permit at least a portion of one of guide members to project outwardly therethrough to a degree sufficient to accommodate installation of said follower within said file drawer by inserting said follower into said file drawer to assume a starting position with said body portion arranged at an angle of other than 90° relative to said side walls and said portion of said one guide member arranged to project outwardly through said opening and then twisting said follower to assume an installed position with said body portion arranged at an angle of approximately 90° relative to said side walls and said guide members positioned within said guide channels, each of said guide members includes leading and trailing guide portions projecting in opposite directions normal to said body portion relatively towards said front and rear ends, respectively, said portion of one of said guide members is said leading guide portion of said one guide member and projects outwardly through said opening and said trailing guide portion of the other of said guide members projects into the guide channel of the other of the side walls when in said starting position, said opening corresponds in shape to said leading guide portion of said one guide member, said guide members engage with said guide channels alternatively to define forward and rearward tilted positions of said follower within said file drawer, wherein items stored within said file drawer intermediate said follower and said front end in engagement with said body portion tend to tilt said follower to assume said forward tilted position, and said portion of said one guide member is misaligned with said opening when said follower is in said forward tilted position, so as to prevent twisting of said follower from said installed position into said starting position.

4. In the combination of a file drawer provided with a pair of spaced-apart vertical side walls having guide channels extending lengthwise thereof intermediate front and rear ends of said file drawer; and a follower having a body portion sized to be received within said file drawer with a pair of spaced side edges thereof arranged adjacent said side walls and a pair of guide members upstanding from said body portion adjacent said side edges and sized and arranged for receipt within said guide channels and for movement lengthwise thereof, the improvement comprising in combination:

a mounting opening extending through one of said side walls in alignment with said guide channel thereof, said opening being sized to permit at least a portion of one of guide members to project outwardly therethrough to a degree sufficient to accommodate installation of said follower within said file drawer by inserting said follower into said file drawer to assume a starting position with said body portion arranged at an angle of other than 90° relative to said side walls and said portion of said one guide member arranged to project outwardly through said opening and then twisting said follower to assume an installed position with said body portion arranged at an angle of approximately 90° relative to said side walls and said guide members positioned within said guide channels, each of said guide members includes leading and trailing guide portions projecting in opposite directions normal to said body portion relatively towards said front and rear ends, respectively, said portion of one of said guide members is said leading guide portion of said one guide member and projects outwardly through said opening and said trailing guide portion of the other of said guide members projects into the guide channel of the other of the side walls when in said starting position, said opening corresponds in shape to said leading guide portion of said one guide member, said portion of said one guide member and said opening have upper and lower edge portions arranged to converge in a direction extending towards said front end of said file drawer, said guide channels have upper and lower guide surfaces engageable with said guide members and permitting tilting movement of said follower within said file drawer between forward and rearward tilted positions, items stored within said file drawer intermediate said follower and said front end and in engagement with said body portion tending to tilt said follower towards said forward tilted position, said upper and lower edge portions of said portion of said one guide member are disposed out of alignment with said upper and lower edge portions of said opening when said follower is in said forward tilted position.

5. The improvement according to claim 4, wherein said upper edge portion of said opening forms an acute angle with said upper guide surfaces of said guide channels equal to or less than about 15°.

6. In the combination of a file drawer provided with a pair of spaced-apart vertical side walls having guide channels extending lengthwise thereof intermediate front and rear ends of said file drawer; and a follower having a body portion sized to be received within said file drawer with a pair of spaced side edges thereof arranged adjacent said side walls and a pair of guide members upstanding from said body portion adjacent said side edges and sized and arranged for receipt within said guide channels and for movement lengthwise thereof, said guide members engage with said guide channels to define a forward tilted position of said follower within said file drawer, wherein items stored within said file drawer intermediate said follower and said front end in engagement with said body portion tend to tilt said follower to assume said forward tilted position, the improvement comprising in combination:

a mounting opening means extending through one of said side walls in alignment with said guide channel thereof, said opening means being sized and arranged to permit at least a portion of one of guide members to be projected outwardly therethrough when said follower is disposed in a rearwardly tilted position to permit removable insertion of said follower within said file drawer, and said portion of said one guide member is misaligned with said opening means when said follower is in said forward tilted position, so as to prevent removal of said follower from said file drawer when said follower is disposed in said forward tilted position.

7. The improvement according to claim 6, wherein said portion of said one guide member and said opening means have upper and lower edge portions arranged to converge in a direction extending towards said front end of said file drawer.

8. The combination according to claim 6, wherein each of said guide members includes leading and trailing guide portions projecting in opposite directions normal to said body portion relatively towards said front and rear ends, respectively, said portion of said one guide member is said leading guide portion of said one guide member, and said opening means corresponds in shape to said leading guide portion of said one guide member.

* * * * *